US011696065B2

(12) United States Patent
Hasan et al.

(10) Patent No.: US 11,696,065 B2
(45) Date of Patent: Jul. 4, 2023

(54) ADAPTIVE ACTIVE NOISE CANCELLATION BASED ON MOVEMENT

(71) Applicant: Plantronics, Inc., Santa Cruz, CA (US)

(72) Inventors: Mohammed Hasan, San Jose, CA (US); Matthew Neves, Watsonville, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 17/481,933

(22) Filed: Sep. 22, 2021

(65) Prior Publication Data

US 2023/0091495 A1 Mar. 23, 2023

(51) Int. Cl.
*H04R 1/10* (2006.01)
*G10K 11/178* (2006.01)

(52) U.S. Cl.
CPC ..... *H04R 1/1083* (2013.01); *G10K 11/17823* (2018.01); *G10K 11/17873* (2018.01); *G10K 2210/1081* (2013.01); *G10K 2210/3213* (2013.01)

(58) Field of Classification Search
CPC ..... H04R 1/1083; G10K 11/17823; G10K 11/17873; G10K 2210/1081; G10K 2210/3213
USPC ..... 381/71.6
See application file for complete search history.

(56) References Cited

U.S. PATENT DOCUMENTS

| | | | | |
|---|---|---|---|---|
| 5,533,134 | A * | 7/1996 | Tokura | H04R 9/04 381/401 |
| 9,706,288 | B2 | 7/2017 | Terlizzi | G10K 11/16 |
| 10,636,405 | B1 * | 4/2020 | Kemmerer | H04R 1/1008 |
| 2016/0027428 | A1 * | 1/2016 | Gul | G10K 11/17833 381/71.4 |
| 2019/0130930 | A1 * | 5/2019 | Tong | G10L 21/0208 |
| 2022/0046364 | A1 * | 2/2022 | Best | G10K 11/17854 |
| 2022/0223133 | A1 * | 7/2022 | McCutcheon | G10K 11/17825 |

FOREIGN PATENT DOCUMENTS

| | | | |
|---|---|---|---|
| KR | 10 1926429 | 3/2019 | H04R 3/00 |
| WO | 2016 007480 | 1/2016 | H04R 3/04 |

* cited by examiner

*Primary Examiner* — Vivian C Chin
*Assistant Examiner* — Friedrich Fahnert
(74) *Attorney, Agent, or Firm* — Quarles & Brady LLP

(57) ABSTRACT

A speaker system includes a speaker, a processor, and an active noise cancellation (ANC) circuit communicatively coupled with the processor. The ANC is configured to apply ANC on audio signals from outside the speaker system to generate a modified audio signal stream through the speaker. The application of ANC is to include generation of ANC signals to interfere with at least part of the audio signals from outside the speaker system in the modified audio signal stream. The processor is configured to determine of low-frequency energy at the speaker system, the low-frequency energy below a threshold frequency. The ANC circuit is configured to, based on the determination of low-frequency energy at the speaker system, perform a corrective action on application of ANC to the audio signals from outside the speaker system.

16 Claims, 2 Drawing Sheets

ADAPTIVE ACTIVE NOISE CANCELLATION BASED ON MOVEMENT

FIELD

The present disclosure relates generally to speaker systems such as headsets and, more particularly, to adaptive active noise cancellation based upon movement.

BACKGROUND

Headphones and headsets are ubiquitous today, not only due to the increasing mobility of media consumption on mobile devices, but also due to an increase in video/audio conferencing and remote work. Some headphones and headsets comprise active noise cancellation (ANC) circuitry that reduces environmental noise to a user in noisy environments, such as on airplanes, in noisy public spaces, or in open space offices. While ANC technology thus increases the listening comfort to the user, the present inventors have determined that ANC systems may provide discomfort to the user when the user is walking or running. This is because the ANC system may amplify vibrations caused by the user's vertical up-and-down motion while walking or running. Accordingly, an object exists to provide a headset with improved, adaptive ANC.

DESCRIPTION

Headsets with ANC circuitry reduce environmental noise to a user who is wearing the headset. However, while ANC increases the listening comfort to the user, inventors of embodiments of the present disclosure have determined that ANC may cause disruptive noise when excessive low-frequency vibrations external to a headset are present. Such low-frequency vibrations may be caused by environmental conditions. Such environmental conditions may include actions of the user. Such actions may include, for example, walking, running. or other movements of the user.

Accordingly, embodiments of the present disclosure may detect vibrations directly or detect movement and infer the vibrations indirectly. Furthermore, embodiments of the present disclosure may selectively adjust ANC based upon such vibration or movement detection. The adjustment of ANC may cause low-frequency vibrations resulting from user movement to not be amplified. Adjustment of ANC may be performed by, for example, reducing an overall ANC gain, disabling feed-forward or feedback ANC paths, or changing filter parameters of ANC so that only a certain portion of the audible spectrum is evaluated for ANC, or that only a certain portion of the audible spectrum has ANC applied to it.

Figure 1:
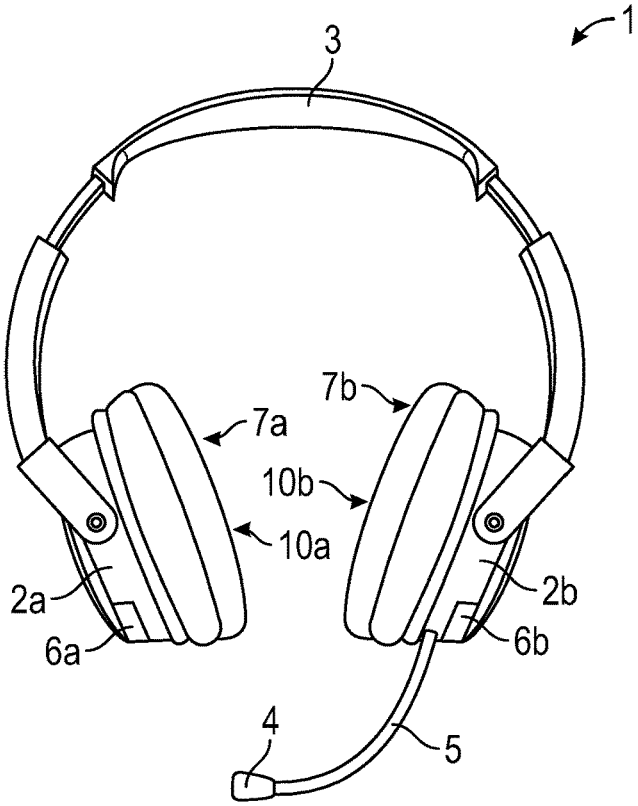
FIG. 1 shows an embodiment of a speaker system including a headset in a schematic front view, according to embodiments of the present disclosure.

FIG. 1 shows a schematic front view of an embodiment of a speaker system, according to embodiments of the present disclosure. The speaker system may be implemented in any suitable manner. For example, the speaker system may be implemented as a headset 1. Headset 1 may be wired or wireless, and may be connected to any other suitable device, such as a computer, laptop, automotive head unit, router, or any other suitable electronic device. Headset 1 may be implemented in any suitable manner, including any headset, headphones, or any other head-worn audio playback device, such as circum-aural and supra-aural headphones, earbuds, in-ear headphones, and other types of wearable earphones.

Headset 1 may comprise two earphones 2*a*, 2*b*. Earphones 2*a*, 2*b* may be implemented in any suitable manner. Earphones 2*a*, 2*b* may be connected electrically or physically in any suitable manner, such as via headband 3. Each earphone 2*a*, 2*b* may comprise a speaker 10*a*, 10*b*. Speakers 10*a*, 10*b*, may be implemented in any suitable manner and may be configured to produce output audio to a user during use. For example, output audio may be produced when a user is wearing headset 1 on their head and headset 1 is powered on and connected to another device. A microphone 4 may be included in headset 1. Microphone 4 may be implemented in any suitable manner. Microphone 4 may be included on, for example, microphone boom 5. Microphone 4 may be employed to capture the user's voice during use. The audio signal from microphone 4 may be used to create a corresponding voice signal to a remote device, such as one used by a remote call participant.

Earphones 2*a*, 2*b* may comprise additional exterior microphones 6*a*, 6*b*. Microphones 6*a*, 6*b* may be implemented in any suitable manner. Microphones 6*a*, 6*b* may be configured to be used as part of an ANC system to provide a so-called feed-forward ANC. Microphones 6*a*, 6*b* may be arranged on the outside of the earphones 2*a*, 2*b* to directly capture environmental noise. Microphones 6*a*, 6*b* may be implemented in any suitable manner. Additional interior ANC microphones 7*a*, 7*b* may be included in headset 1 and may be arranged on the inside of the earphones 2*a*, 2*b*. Microphones 7*a*, 7*b* may be arranged next to the two speakers 10*a*, 10*b*. Microphones 7*a*, 7*b* may be implemented in any suitable manner. During use, these two interior ANC microphones 7*a*, 7*b* may be provided in a closed space between earphones 2*a*, 2*b* and the user's eardrum. The two interior ANC microphones 7*a*, 7*b* may be part of the ANC system to provide so-called feedback ANC. Together, the exterior ANC microphones 6*a*, 6*b* and the interior ANC microphones 7*a*, 7*b* may allow the ANC system to provide a hybrid ANC. Hybrid ANC may be a combination of feedback ANC and feed-forward ANC.

The headset 1 comprises further internal components, some of which are discussed in more detail with reference to the schematic block diagram of FIG. 2. Moreover, headset 1 may include any other suitable components, not shown, such as headbands, ear loops, ear cushions, cable assemblies, clothing clips, or housings.

Figure 2:
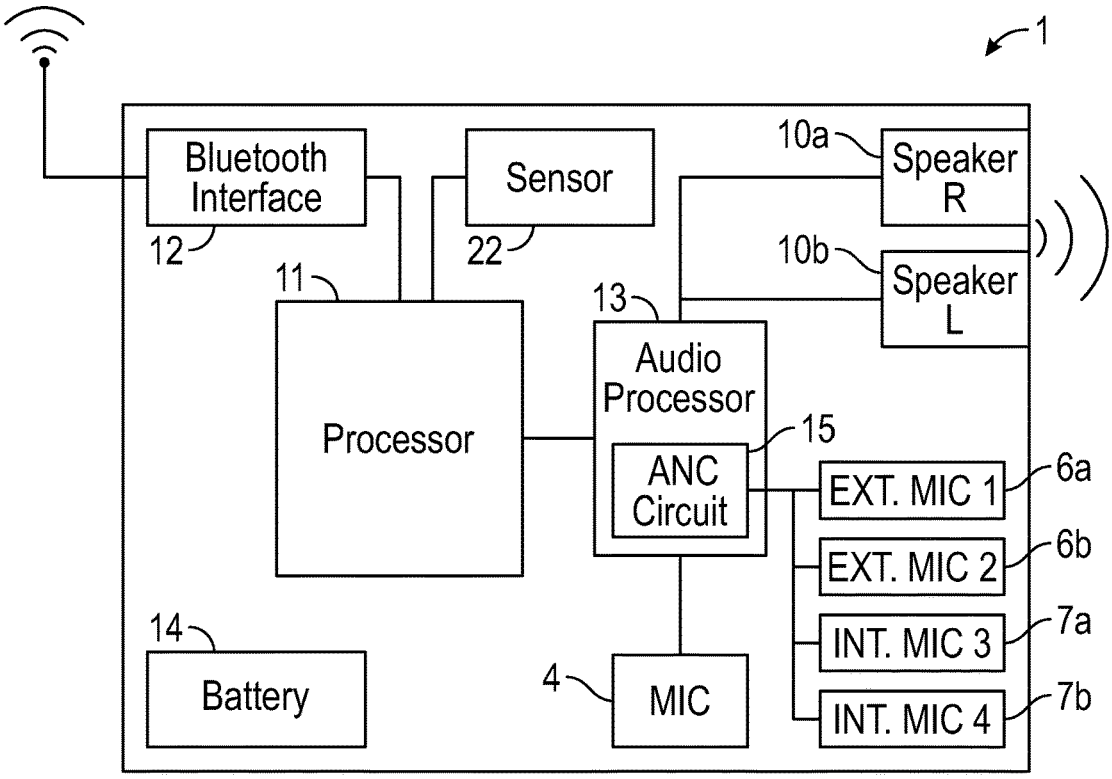
FIG. 2 shows a schematic of a circuit board of the headset, according to embodiments of the present disclosure.

FIG. 2 shows a schematic block diagram of headset 1, according to embodiments of the present disclosure.

Headset 1 may include a processor 11. Processor 11 may be implemented in any suitable manner, such as by a microprocessor, microcontroller, a digital signal processor (DSP), a field-programmable gate array, or an application-specific integrated circuit. Processor 11 may be configured to execute instructions stored in a memory. Processor 11 may be configured to provide headset functionality such as providing output audio to a user from incoming audio data to the headset. Processor 11 may be configured to provide outgoing audio data to a remote device based on user audio. The user audio may be generated by, for example, microphone 4. The audio may be sent and received through any suitable format or protocol. For example, headset 1 may include a Bluetooth interface 12.

Headset 1 may include an audio processor 13 with an amplifier circuit (not shown). Audio processor 13 may be implemented in any suitable manner, such as by analog circuitry, digital circuitry, instructions for execution by a processor, or any suitable combination thereof. For example, audio processor 13 may be implemented as a DSP. Audio processor 13 may be integrated with processor 11. Audio processor 13 may be configured to perform any suitable signal processing or signal conditioning, such as processing incoming audio data, providing equalization and digital to analog conversion, and driving speakers 10*a*, 10*b*. Audio processor 13 may also be configured to process user audio received via microphones 4, 6, 7 and to provide a corresponding digital audio stream to processor 11 for transmission via the Bluetooth interface 12. Any suitable power source, such as a battery 14, may be included to provide power to the components of headset 1. Microphones 4, 6, 7 may be connected directly to audio processor 13.

Audio processor 13 may include an ANC circuit 15. ANC circuit 15 may be implemented in any suitable manner, such as by analog circuitry, digital circuitry, instructions for execution by a processor, or any suitable combination thereof. In the example of FIG. 2, ANC circuit 15 may be implemented as software code stored in a memory of audio processor 13. ANC circuit 15 may be configured to actively cancel or reduce noise to the user of headset 1. This may be performed, for example, by reducing unwanted external sound by the addition of a further sound specifically designed to cancel the unwanted external sound. ANC may also be referred to as active noise reduction (ANR). ANC circuit 15 may be configured to provide any suitable ANC, such as feed-forward ANC, feedback ANC, or hybrid ANC. Hybrid ANC may refer to performance of both feed-forward and feedback ANC. In various embodiments, ANC circuit 15 may be integrated with processor 11 or audio processor 13.

Feed-forward ANC is a type of ANC wherein ANC circuit 15 uses at least one of microphones 4, 6, 7 for capturing noise, wherein microphones 4, 6, 7 are located on the outside of the headset (such as microphone 4). In other words, the given microphone used for capturing is not located in the generally closed space between the eardrum of the user and the respective earphone 2. Feed-forward ANC may reduce the degree to which a user of headset 1 hears their own voice. Thus, reducing or switching off feed-forward ANC may cause a user of headset 1 to hear more of their own voice when wearing headset 1 and speaking. In feedback ANC, ANC circuit 16 may use another of microphones 4, 6, 7 (such as one of microphones 7) that is located in the generally closed space between the eardrum of the user and the respective earphone 2, or connected to a sealed port which leads into the space between a respective earphone 2 and a user's eardrum. Such a configuration may be used when, for example, earphones 2 are implemented as earbuds.

The functionality of ANC circuit 15, and in particular that of a feed-forward ANC algorithm and a feedback ANC algorithm, may be obtained when the software code is executed on audio processor 13. In some embodiments, the functionality of ANC circuit 15 may be provided by hard-wired logic alone, which may be discrete or integrated.

Audio processor 13 and ANC circuit 15 may be connected with the exterior ANC microphones 6*a*, 6*b* and the interior ANC microphones 7*a*, 7*b* to capture environmental noise. Audio processor 13 and ANC circuit 15 may be configured to provide signals that cancel out or reduce the environmental noise for the user. The exterior ANC microphones 6*a*, 6*b* may be used by the feed-forward ANC algorithm of the ANC circuit 15 and the interior ANC microphones 7*a*, 7*b* may be used by the feedback ANC algorithm of the ANC circuit 15, Microphones 4, 6, 7 may be implemented in any suitable manner to obtain an audio signal of the user's voice during use. Microphones 4, 6, 7 may be of the same or of different types of transducers to convert or "translate" the acoustic signals received into the corresponding electric signals. For example, microphones 4, 6, 7 may be of dynamic, condenser, electret, ribbon, carbon, piezoelectric, fiber optic, laser, or MEMS type.

During use, headset 1 may receive an incoming audio data stream from an external device (not shown). The external device may be a Bluetooth device. The external device may be implemented in any suitable manner, such as a desktop computer, laptop, smartphone, or tablet. Data connections between headset 1 and the external device may be implemented in any suitable manner, such as universal serial bus (USB), Bluetooth, Internet telephony systems, or video conferencing systems. For example, the incoming audio data stream may be received via Bluetooth interface 12. Headset 1 may provide the corresponding audio to the user. Moreover, the user's voice may be captured by microphone 4 and a corresponding outgoing audio data stream may be transmitted via Bluetooth interface 12 to the Bluetooth device and the remote device consequently.

The user may be able to selectively switch on ANC circuit 15 in any suitable manner. This may be performed, for example, via software on the remote Bluetooth device or a user interface such as a button (not shown) provided on earphone 2*b*. ANC circuit 15 may provide hybrid ANC (a combination of feedback ANC and feed-forward ANC).

Headsets that use hybrid ANC may experience an amplification of very low-frequency energy from the environment. The amplification may be of frequencies less than, for example, 40 Hz. Such low-frequency energy may arise from, for example, the vibrations arising from a user walking or running. The low-frequency energy may be amplified as if the low-frequency energy was part of the cancellation of external noise as part of ANC.

Accordingly, headset 1 may be configured to determine if a user is experiencing low-frequency vibration. This determination may be made in any suitable manner. In one embodiment, headset 1 may directly measure the vibrational movement of headset 1 for vibration. For example, headset 1 may include accelerometers to measure the movement of headset 1. In another embodiment, headset 1 may infer the vibrations from other detected movements of headset 1. For example, headset 1 may receive information from a paired electronic device, such as a smartphone, that the smartphone and headset are moving with a given velocity.

As shown in FIG. 2, headset 1 may include a sensor 22. Sensor 22 may be implemented in any suitable manner to provide vibration or movement information. In one embodiment, sensor 22 may be implemented by an accelerometer. In another embodiment, sensor 22 may be implemented by a global positioning system (GPS) circuit. In yet another embodiment, sensor 22 may be implemented by a step counter, configured to count the number of steps taken by a user as a part of biometrics information. In still yet another embodiment, sensor 22 may be implemented by a heartrate monitor. In various embodiments, sensor 22 may be implemented elsewhere besides headset 1, and may be communicatively connected to processor 11. Sensor 22 and processor 11 may be communicatively connected in any suitable manner and through any suitable protocol, such as wirelessly through Bluetooth. Sensor 22 may be configured to provide vibration or movement data to processor 11 through such a connection. The vibration or movement data in such cases may be inferred as being applicable to headset 1. For example, a smartwatch or smartphone may include sensor 22, wherein sensor 22 is implemented as a step counter or a heartrate monitor. If sensor 22 in a smartwatch or smartphone paired with headset 1 indicates that a user is taking steps, as part of the smartwatch or smartphone's biometric data, then the smartwatch or smartphone information received at processor 11 from sensor 22 may be assumed to also be applicable to headset 1.

Processor 11 is configured to determine whether the vibration or movement information indicates that low-frequency energy is likely to be amplified. This may include, for example, determining whether the vibration or movement information indicates that a user of headset 1 is walking or running. The vibration or movement information can be received from sensor 22. Processor 11 can consider the degree of acceleration in, for example, a vertical axis, to determine whether steps of walking or running are being taken by the user. Processor 11 can determine from this that low-frequency energy is likely to be amplified. Moreover, processor 11 can receive a direct indication from a smartphone or smartwatch that steps are being taken by the user. Such a direct indication can be provided by an instance of sensor 22 on the smartphone or smartwatch. Processor 11 can determine from this indication that steps are being taken by the user that low-frequency energy is likely to be amplified. In another example, processor 11 can receive information from a smartphone that the user is moving at a given velocity that exceeds a threshold. Processor 11 can determine from this information that the user is moving at a given velocity that low-frequency energy is likely to be amplified.

Processor 11 provides information to ANC circuit 15 that vibration or movement information, or other suitable information, indicates that low-frequency energy is likely to be amplified. ANC circuit 15 is configured to take any suitable corrective action. The corrective action can reduce or eliminate amplification of low-frequency energy caused by repeated vertical movement of the user while walking or running. The bouncing of the user, up and down, while walking or running, may cause low-frequency vibrations, such as those below 40 Hz. As discussed above, this repeated vertical movement may be detected directly by, for example, an accelerometer, or inferred from other sensors that the user is moving or is taking steps.

In one embodiment of the corrective action, ANC circuit 15 may tune or adjust the overall ANC gain downwards. In a further embodiment, the overall ANC gain may be reduced, but not to zero. In another further embodiment, the overall ANC gain may be adjusted downwards as a ramp function over a time period. The time period may be, for example, 5-15 seconds. The overall ANC gain may be adjusted from an initial value down to a minimum over the course of the time period. In one embodiment, the minimum value may zero. In another embodiment, the minimum value may be a non-zero value. The non-zero minimum value may be set so as to eliminate amplification of low-frequency noise caused by a user walking or running, but without completely disabling ANC for other frequencies. By adjusting the overall ANC gain down over the course of a time period, rather than immediately, suddenly or jarringly changing the overall ANC gain may be avoided. Suddenly or jarringly changing the overall ANC gain may be disruptive to the user. The overall ANC gain may be adjusted downwards by changing one or more of the ANC feed-forward gain, ANC feedback gain, microphone gains, and filter gains. The ANC feed-forward gain, ANC feedback gain, microphone gains, and filter gains may themselves be increased, decreased, or set to zero.

In another embodiment of the corrective action, the feedback paths or feed-forward paths for ANC may be disabled as a corrective action. In a further embodiment, the feedback path may be disabled as a corrective action, as feedback in ANC may be more likely to amplify low-frequency energy.

In yet another embodiment of the corrective action, the filter parameters of ANC may be adjusted so that only a certain portion of the spectrum is evaluated for ANC, or that only a certain portion of the spectrum has ANC applied to it. For example, ANC circuit 15 may enable ANC filtering for frequencies only greater than 100 Hz. This may be gradually employed over the time period.

In various embodiments, as the end of movement or vibration is detected, processor 11 may inform ANC circuit 15. ANC circuit 15 may reverse the corrective actions that were previously taken. Moreover, to the extent that the corrective actions were taken over time, reversing the corrective actions may be performed over time as well. For example, after taking the corrective action of ramping down the overall ANC gain from its initial setting towards a minimum over a given time period, ANC circuit 15 may ramp up the overall ANC gain from its ending point back towards the initial setting.

Figure 3:
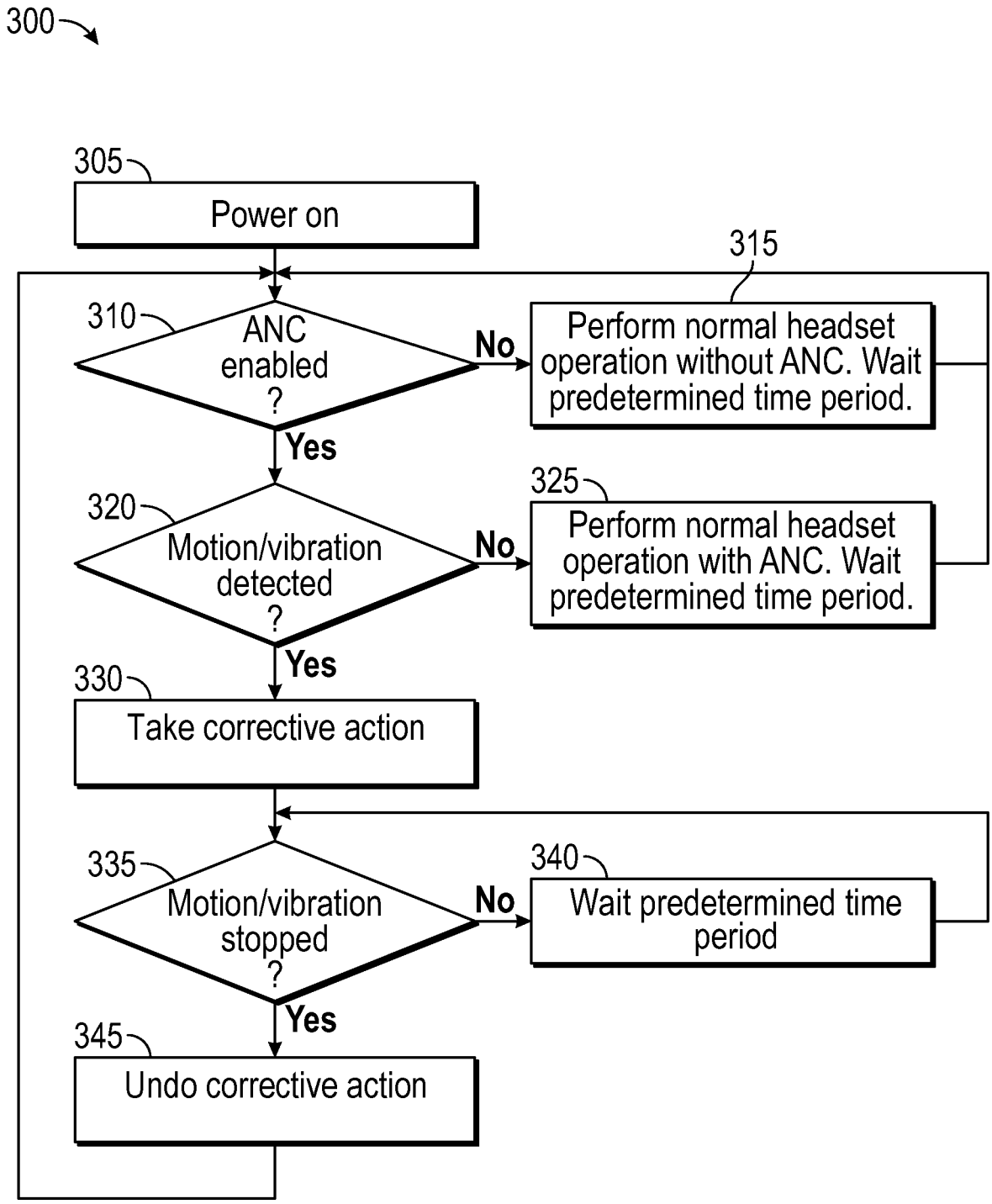
FIG. 3 shows a method for adaptive ANC performed by the headset, according to embodiments of the present disclosure.

FIG. 3 shows an exemplary flow diagram of the operation of the adaptive ANC of headset 1 of the present embodiment, thus performing a method 300 for adaptive ANC, according to embodiments of the present disclosure. Method 300 may be performed by any suitable portion of headset 1, such as by processor 11 and ANC circuit 15. Method 300 may include more or fewer steps than shown in FIG. 3. The steps of method 300 may be performed in any suitable order. Various steps of method 300 may be repeated, omitted, performed recursively, or performed in parallel.

At step 305, headset 1 may be powered on using the user interface (not shown).

At step 310, processor 11 may determine whether ANC is enabled for headset 1. If so, method 300 may proceed to step 320. Otherwise, method 300 may proceed to step 315.

At step 315, processor 11 may perform normal headset operation, in which audio signals are input and output from headset 1, without the use of ANC. Method 300 may wait a predetermined time period and may return to step 310. Audio signals may continue to be input and output from headset 1 in parallel while step 310 is processed again, as necessary.

At step 320, processor 11 may determine whether motion or vibration has been detected. Such motion or vibration may be sufficient to possibly cause low frequency energy amplification. If so, method 300 may proceed to step 330. Otherwise, method 300 may proceed to step 325.

At step 325, processor 11 may perform normal headset operation, in which audio signals are input and output from headset 1, with the use of ANC. Environmental noise may be reduced or canceled. The ANC may be tuned and adjusted over time. Method 300 may wait a predetermined time period and may return to step 310. Any suitable predetermined time period may be used, such as one second. Audio signals may continue to be input and output from headset 1 in parallel while step 310 is processed again, as necessary.

At step 330, any suitable corrective action may be taken by ANC circuit 15. One or more corrective actions may be taken, such as ramping down an overall ANC gain from an initial value to a minimum value, adjusting the ANC filter parameters, or disabling ANC feedback or feed-forward paths. The corrective actions may be performed over time.

At step 335, processor 11 may determine whether the motion or vibration has stopped. Such a determination may be made before the corrective actions in step 330 are complete. If so, method 300 may proceed to step 345. Otherwise, method 300 may proceed to step 340 to wait a predetermined time period while continuing to perform the corrective actions, before repeating step 335.

At step 345, the corrective actions taken in step 330 may be undone by ANC circuit 15. The gain may be ramped up from its existing value back to the original value. The filtering of frequencies may be restored. ANC feedback may be enabled. Method 300 may return to, for example, step 310.

Embodiments of the present disclosure may include a speaker system. The speaker system may be implemented in any suitable manner, such as by a headset. The headset may be implemented in any suitable manner, and may be wired or wireless and may include headphones such as circum-aural and supra-aural headphones, earbuds, in-ear headphones, or any type of wearable earphones or other wearable or head-worn audio playback device. The speaker system may include any suitable number and kind of speakers, including at least one speaker. The speaker system may include a processor. The speaker system may include an ANC circuit. The ANC circuit may be communicatively coupled with the processor and configured to apply ANC on audio signals from outside the speaker system to generate a modified audio signal stream through the speaker. The application of ANC by the ANC circuit may include generation of ANC signals to interfere with at least part of the audio signals from outside the speaker system in the modified audio signal stream. The processor may be configured to detect or determine low-frequency energy or an indication thereof at the speaker system. The low-frequency energy below a threshold frequency. The threshold frequency may be, for example, 40 Hz. The ANC circuit may be configured to, based on the determination, detection, or indication of low-frequency energy at the speaker system, perform a corrective action on the application of ANC to the audio signals from outside the speaker system.

In combination with any of the above embodiments, the determination, detection, or indication of low-frequency energy at the speaker system includes a measurement of vibration of the speaker system. The measurement may be made by any suitable sensor. The sensor may be included in the speaker system or communicatively coupled to the speaker system in an electronic device.

In combination with any of the above embodiments, the determination, detection, or indication of low-frequency energy at the speaker system may be an indication of movement of the speaker system. The determination, detection, or indication of low-frequency energy may be generated by movement of the speaker system. The movement of the speaker system may cause the ANC circuit to perform ANC amplification of low-frequency energy. The movement of the speaker system may be determined by any suitable sensor. The sensor may be included in the speaker system or communicatively coupled to the speaker system in an electronic device.

In combination with any of the above embodiments, the determination, detection, or indication of movement of the speaker system may include a determination, detection, or indication that a user of the speaker system is walking or running. The walking or running of the user may cause low-frequency energy that corresponding ANC may be disturbing to the user.

In combination with any of the above embodiments, the corrective action performed by the ANC circuit may include reduction of amplification of low-frequency energy caused by repeated vertical movement of the user while walking or running.

In combination with any of the above embodiments, the corrective action performed by the ANC circuit may include disabling ANC feedback paths.

In combination with any of the above embodiments, the corrective action performed by the ANC circuit may include disabling ANC feed-forward paths.

In combination with any of the above embodiments, the corrective action performed by the ANC circuit may include reducing an overall ANC gain of the ANC circuit. The overall ANC gain may be adjusted downwards by changing one or more of the ANC feed-forward gain, ANC feedback gain, microphone gains, and filter gains. The ANC feed-forward gain, ANC feedback gain, microphone gains, and filter gains may themselves be increased, decreased, or set to zero.

In combination with any of the above embodiments, the corrective action performed by the ANC circuit includes reducing an overall ANC gain of the ANC circuit to a minimum value over a time period. Any suitable minimum value may be used. The minimum value may be non-zero.

In combination with any of the above embodiments, the corrective action performed by the ANC circuit may include changing ANC filter settings to reduce the application of ANC to lower frequency input.

Embodiments of the present disclosure may include an article of manufacture. The article may include a non-transitory machine-readable medium. The medium may include instructions. The instructions, when loaded and executed by a processor, may cause the processor to perform any of the operations of any of the above embodiments.

Embodiments of the present disclosure may include methods including the operation of any of the above embodiments.

The invention has been described in the preceding using various exemplary embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor, module, or other unit or device may fulfill the functions of several items recited in the claims.

The term "exemplary" used throughout the specification means "serving as an example, instance, or exemplification" and does not mean "preferred" or "having advantages" over other embodiments.

The mere fact that certain measures are recited in mutually different dependent claims or embodiments does not indicate that a combination of these measures cannot be used to advantage. Any reference signs in the claims should not be construed as limiting the scope.

Specific embodiments of the invention are here described in detail, above. In the preceding description of embodiments of the invention, the specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

In the preceding explanation of the present invention according to the embodiments described, the terms "coupled (to/with)" and "connected (to/with)" are used to indicate a data or audio connection between at least two parts, components, or objects. Such a connection may be direct between the respective parts, components, or objects; or indirect, i.e., over intermediate parts, components, or objects. The connection may be a wired or wireless connection. It is noted that the above terms may also be used to indicate a physical or mechanical connection.

In the preceding description, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between like-named elements. For example, a first element is distinct from a second element, and the first element may encompass more than one element and succeed (or precede) the second element in an ordering of elements.

What is claimed is:

1. A speaker system, comprising:

a speaker;

a processor; and an active noise cancellation (ANC) circuit communicatively coupled with the processor and configured to apply ANC on audio signals from outside the speaker system to generate a modified audio signal stream through the speaker, the application of ANC to include generation of ANC signals to interfere with at least part of the audio signals from outside the speaker system in the modified audio signal stream; wherein:

the processor is configured to detect low-frequency energy at the speaker system, the low-frequency energy below a threshold frequency;

the ANC circuit is configured to, based on the detection of low-frequency energy at the speaker system, perform a corrective action on application of ANC to the audio signals from outside the speaker system; and the corrective action performed by the ANC circuit includes reducing an overall ANC gain of the ANC circuit to a minimum value as a ramp function over a time period.

2. The speaker system of claim 1, wherein the detection of low-frequency energy at the speaker system includes a measurement of vibration of the speaker system.

3. The speaker system of claim 1, wherein the low-frequency energy at the speaker system is generated by movement of the speaker system.

4. The speaker system of claim 1, wherein the detection of low frequency energy at the speaker system includes a determination that a user of the speaker system is walking or running.

5. The speaker system of claim 4, wherein the corrective action performed by the ANC circuit includes reduction of amplification of low-frequency energy caused by repeated vertical movement of the user while walking or running.

6. The speaker system of claim 1, wherein the corrective action performed by the ANC circuit includes disabling ANC feedback.

7. The speaker system of claim 1, wherein the corrective action performed by the ANC circuit includes changing ANC filter settings to reduce the application of ANC to lower frequency input.

8. A method, comprising, at a speaker system:

receiving audio signals from outside the speaker system;

applying active noise cancellation (ANC) on the audio signals to generate a modified audio signal stream through the speaker, including generating ANC signals by an ANC circuit to interfere with at least part of the audio signals from outside the speaker system in the modified audio signal stream; determining of low-frequency energy at the speaker system, the low-frequency energy below a threshold frequency; and based on the determination of low-frequency energy at the speaker system, performing a corrective action on application of ANC to the audio signals from outside the speaker system, wherein performing the corrective action includes reducing an overall ANC gain of the ANC circuit to a minimum value as a ramp function over a time period.

9. The method of claim 8, wherein the determination of low-frequency energy at the speaker system includes a measurement of vibration of the speaker system.

10. The method of claim 8, wherein the low-frequency energy at the speaker system is generated by movement of the speaker system.

11. The method of claim 8, wherein a determination of movement of the speaker system includes an indication that a user of the speaker system is walking or running.

12. The method of claim 11, wherein performing the corrective action includes reducing amplification of low-frequency energy caused by repeated vertical movement of the user while walking or running.

13. The method of claim 8, wherein performing the corrective action includes disabling ANC feedback.

14. The method of claim 8, wherein performing the corrective action includes changing ANC filter settings to reduce the application of ANC to lower frequency input.

15. An article of manufacture comprising a non-transitory machine-readable medium, the medium including instructions, the instructions, when loaded and executed by a processor, cause the processor to:

receive audio signals from outside a speaker system;

apply active noise cancellation (ANC) on the audio signals to generate a modified audio signal stream through the speaker, including generation of ANC signals by an ANC circuit to interfere with at least part of the audio signals from outside the speaker system in the modified audio signal stream;

detect low-frequency energy at the speaker system, the low-frequency energy below a threshold frequency; and based on the detection of low-frequency energy at the speaker system, perform a corrective action on application of ANC to the audio signals from outside the speaker system, wherein performing the corrective action includes reducing an overall ANC gain of the ANC circuit to a minimum value as a ramp function over a time period.

16. The article of claim 15, wherein the detection of low-frequency energy at the speaker system includes a detection of movement of the speaker system, the movement of the speaker system to cause the ANC circuit to perform ANC amplification of low-frequency energy.

* * * * *